US011034914B2

(12) United States Patent
Lange et al.

(10) Patent No.: US 11,034,914 B2
(45) Date of Patent: Jun. 15, 2021

(54) DESULFURIZED BLACK LIQUOR SOAP COMPOSITIONS AND PROCESSES FOR PRODUCING

(71) Applicant: Kraton Polymers LLC, Houston, TX (US)

(72) Inventors: Jos H. M. Lange, Almere (NL); Godfried J. H. Buisman, Almere (NL); Charles D. Foran, Savannah, GA (US)

(73) Assignee: Kraton Polymers LLC, Houston, TX (US)

( * ) Notice: Subject to any disclaimer, the term of this patent is extended or adjusted under 35 U.S.C. 154(b) by 0 days.

(21) Appl. No.: 16/395,526

(22) Filed: Apr. 26, 2019

(65) Prior Publication Data

US 2019/0338218 A1 Nov. 7, 2019

Related U.S. Application Data

(60) Provisional application No. 62/664,996, filed on May 1, 2018.

(51) Int. Cl.

| | |
|---|---|
| ***C11B 13/00*** | (2006.01) |
| ***C11B 3/00*** | (2006.01) |
| ***C11B 3/06*** | (2006.01) |
| ***C11B 3/12*** | (2006.01) |
| ***D21C 11/00*** | (2006.01) |

(52) U.S. Cl.
CPC ..... *C11B 13/005* (2013.01); *C11B 3/006* (2013.01); *C11B 3/06* (2013.01); *C11B 3/12* (2013.01); *D21C 11/0007* (2013.01)

(58) Field of Classification Search
CPC ..... C11B 13/005; C11B 13/02
See application file for complete search history.

(56) References Cited

U.S. PATENT DOCUMENTS

| | | | | | |
|---|---|---|---|---|---|
| 1,813,512 | A | * | 7/1931 | Rutzler, Jr. | C11D 13/06 554/156 |
| 1,887,246 | A | | 11/1932 | Evald | |
| 2,227,203 | A | * | 12/1940 | Scott | C11D 13/30 530/208 |
| 2,240,365 | A | * | 4/1941 | Dreger | C09F 1/00 530/208 |
| 2,285,902 | A | * | 6/1942 | Christmann | C11D 15/00 530/205 |
| 2,296,952 | A | | 9/1942 | Ross et al. | |
| 2,802,845 | A | * | 8/1957 | Sadler | C11B 13/02 554/179 |
| 3,575,952 | A | * | 4/1971 | Morris et al. | C09F 1/02 530/208 |
| 4,005,060 | A | | 1/1977 | Mannbro | |
| 4,076,700 | A | | 2/1978 | Harada et al. | |
| 4,118,407 | A | * | 10/1978 | Red | C11B 13/02 554/178 |
| 4,154,725 | A | * | 5/1979 | Otrhalek | C11B 13/02 530/208 |
| 4,248,769 | A | * | 2/1981 | Johansson | C11D 15/00 162/16 |
| 4,495,095 | A | * | 1/1985 | Lawson | C11B 13/02 530/209 |
| 5,132,399 | A | | 7/1992 | MacDonald et al. | |
| 5,543,110 | A | * | 8/1996 | Starr | A61L 9/01 162/51 |
| 5,898,065 | A | * | 4/1999 | Aitta | C11B 13/02 530/205 |
| 6,348,566 | B1 | * | 2/2002 | Sarasto | C11B 13/02 530/205 |
| 8,419,897 | B2 | | 4/2013 | Bowles et al. | |
| 9,546,342 | B1 | * | 1/2017 | Sutterlin | C07C 51/15 |
| 9,745,541 | B1 | * | 8/2017 | Sutterlin | C11B 1/10 |
| 2001/0049452 | A1 | * | 12/2001 | Reaney | C11C 1/08 554/174 |
| 2002/0009785 | A1 | * | 1/2002 | Reaney | C12N 1/20 435/134 |
| 2004/0265205 | A1 | * | 12/2004 | Kjellberg | D21C 11/0007 423/423 |
| 2009/0113786 | A1 | * | 5/2009 | Lindstrom | C11B 13/005 44/308 |
| 2011/0049012 | A1 | * | 3/2011 | Stigsson | C11B 3/10 208/88 |
| 2012/0123087 | A1 | * | 5/2012 | Bowles | C11B 13/02 530/208 |
| 2012/0296066 | A1 | * | 11/2012 | Hofstedt | C11B 13/005 530/205 |
| 2015/0166931 | A1 | * | 6/2015 | Bowles | C11B 13/005 530/208 |
| 2015/0307810 | A1 | * | 10/2015 | Stigsson | B01D 3/28 554/175 |
| 2016/0194523 | A1 | * | 7/2016 | Evdokimov | C09F 1/02 530/208 |
| 2016/0264821 | A1 | * | 9/2016 | Nelson | C09D 193/04 |
| 2017/0088794 | A1 | * | 3/2017 | Finer | C11B 3/006 |
| 2017/0283738 | A1 | * | 10/2017 | Foran | C11B 13/005 |
| 2018/0273801 | A1 | * | 9/2018 | Severance | C08K 3/04 |

FOREIGN PATENT DOCUMENTS

| | | |
|---|---|---|
| EP | 0952208 A2 | 10/1999 |
| EP | 1568760 A1 | 8/2005 |

(Continued)

OTHER PUBLICATIONS

Andrey N Evdokimo,Desulfurization of black liquor soap for production of crude tall oil with lower sulfur content,Wood Science and Technology, Nov. 2017,1353-1363,vol. 51.

*Primary Examiner* — Liam J Heincer

(57) ABSTRACT

A method to purify black liquor soap (BLS) from sulfur compounds is disclosed. In the BLS desulfurization method, a BLS composition is heated in an inert atmosphere and sulfur is removed via aqueous extractions with inorganic base in the absence of other chemicals such as brine, sulfate salts and carbonate salts. The purified BLS composition exhibits favorable properties, including reduced sulfur content, lower color, and improved odor characteristics. The resulting tall oil compositions, depitched tall oil compositions, tall oil distillation fractions, and products derived therefrom also show reduced sulfur content, lower color, and improved odor characteristics.

11 Claims, No Drawings

(56) References Cited

FOREIGN PATENT DOCUMENTS

| | | | |
|---|---|---|---|
| EP | 3115445 | A1 | 1/2017 |
| WO | 2004/074415 | A1 | 9/2004 |

* cited by examiner

DESULFURIZED BLACK LIQUOR SOAP COMPOSITIONS AND PROCESSES FOR PRODUCING

RELATED APPLICATIONS

This application claims priority from U.S. Application No. 62/664,996, with a filing date of May 1, 2018, the disclosures is incorporated herein by reference.

FIELD

The disclosure relates to methods of purifying/removing sulfur compounds from black liquor soap (BLS), purified BLS compositions, and compositions derived therefrom.

BACKGROUND

The Kraft process in the paper pulping industry produces black liquor soap (BLS), which contains sulfur. The presence of sulfur compounds in BLS-derived materials such as in tall oil and tall oil derived products can limit the scope of their end use applications, for example due to malodor. Sulfur impurities are known to act as noble metal catalyst poisoners, can have a detrimental impact on catalytic hydrogenation and disproportionation reactions and can contribute to corrosion. There is a need for industrial applicable, cost-effective and safe BLS desulfurization processes.

The prior art BLS desulfurization processes have been carried in the presence of aqueous hydrogen peroxide ($H_2O_2$) solution and concentrated caustic soda in the presence of brine (NaCl). As a result of oxidative desulfurization methods, sulfides are oxidized into more polar sulfoxides and sulfones, but such methods can also lead to concomitant detrimental oxidation of sensitive tall oil components such as abietic acid and linoleic acid and can lead to excessive foaming due to oxidant decomposition and release of oxygen gas.

The acidulation of BLS into CTO with sulfuric acid results in the formation of $Na_2SO_4$. In current paper mills, the recovery boiler is an essential section to recover the inorganic sodium salts NaOH and $Na_2S$ in order to render the Kraft paper pulping process economical viable. During such a recycling process, the presence of halogen ions like in brine (NaCl) is undesirable and can deteriorate the chemical recycling process, e.g., formation of tenacious deposits in recovery boilers. In the acidulation or refinery process, the halogen atoms might react with tall oil components, which may lead to a covalent incorporation of halogen atoms into tall oil and its refined products.

There is still a need for better BLS desulfurization processes resulting in low sulfur content, negligible halogen content, a low color, improved odor properties, e.g., low odor intensity and low odor hedonic tone. In particular, as part of a sustainable process wherein applied chemicals can be recycled.

SUMMARY

In one aspect, the disclosure provides a method of purifying black liquor soap (BLS) from sulfur compounds by: subjecting the BLS to one or more extractions with of an aqueous alkaline solution comprising 1-15 mol/L of inorganic base, the inorganic base is selected from the group consisting of NaOH, LiOH, KOH and any combination thereof, the weight ratio of the applied aqueous alkaline solution/black liquor soap mixture is greater than 1/10 and less than 20/1; optionally heating the BLS in an inert atmosphere or in a vacuum at a temperature in the range of 160° C. to 320° C., wherein the alkaline solution is substantially free from brine, sulfate salts or carbonate salts, and wherein the total solids sulfur content of the BLS is reduced by at least 30% and wherein the purified BLS has a chloride content of less than 1000 ppm.

In yet another aspect, the disclosure provides crude tall oil compositions purified from sulfur, dehydrated crude tall oil compositions purified from sulfur, depitched crude tall oil compositions purified from sulfur and depitched crude tall oil distillation fractions purified from sulfur, including tall oil rosin (TOR), tall oil fatty acid (TOFA), distilled tall oil (DTO) and tall oil pitch (TOP), and chemical compositions derived therefrom, which compositions are resulting from successive acidulation, dewatering, depitching and subsequent fractionations and chemical reactions of the obtained BLS compositions purified from sulfur, according to the desulfurization methods herein.

DESCRIPTION

The following terms will be used throughout the specification and will have the following meanings.

"Substantially free" is used herein to describe an alkaline solution, comprising inorganic base such as NaOH, LiOH or KOH that contains less than 5%, preferably less than 3%, more preferably less than 1% by weight of brine, sulfate salts, or carbonate salts.

In one aspect, the disclosure provides a method of purifying black liquor soap from sulfur by means of one or more extractions with an aqueous alkaline solution substantially free from brine, sulfate salts or carbonate salts.

Black Liquor Soap (BLS) Feedstock: Black liquor, from which tall oil is obtained, is an aqueous solution separated from the cellulosic portions of wood in the manufacture of paper pulp by alkaline processes. It typically contains fatty acid soaps, resin soaps (rosin acid sodium salts), and unsaponifiable organic compounds. The fatty acids are predominantly oleic and linoleic acids with small quantities of linolenic, stearic and palmitic acid. The rosin acids are monocarboxylic diterpene acids having a general formula $C_{20}H_{30}O_2$. The predominant rosin acids are abietic and dehydroabietic acid.

When the black liquor from the Kraft process is concentrated, a large proportion of the soap will separate and can be collected by skimming it from the concentrated black liquor surface. BLS in general contains 25-40 wt. % of entrained water and has a sulfur content which typically ranges from 1200-3000 ppm, and a total solids sulfur content which typically ranges from 1800-4500 ppm.

Method for Purifying BLS: The BLS is purified for the removal of sulfur by being brought into contact with an aqueous alkaline solution comprising an inorganic base, via contact methods and equipment known in the art.

The contact with the aqueous alkaline solution is for any period of time of at least 1 minute, at least 10 minutes, at least 15 minutes, at least 30 minutes, and at least 2 hrs.

The contact can be either con-current or countercurrent, or via a non-dispersive or dispersive method. The dispersive method can be via mixing tanks, vessels, static mixers, etc. The non-dispersive method can be via contactors.

The inorganic base is selected from the group consisting of NaOH, LiOH, KOH, and mixtures thereof. The aqueous alkaline solution is substantially free of brine, sulfate salts or carbonate salts, containing the inorganic base at a concentration of 1-15 mol/L, or 1.2-7 mol/L, or 1.4-4 mol/L, or 1.2-8 mol/L, or 1.4-7 mol/L, or 1.8-6 mol/L, or at least 1.2 mol/L of inorganic base. An aqueous 1-15 mol/L NaOH solution contains 4-42 wt. % of NaOH.

Optionally, the aqueous alkaline solution comprises 0.1 to 4 wt. % of hydrogen peroxide, or alternatively 0.01 to 4 wt. % of hydrogen peroxide. The optional hydrogen peroxide can be added in doses of 0.05, 0.1, 0.5, 1, 2, or 3 wt. %. Optionally, an anti-foaming agent can be added in BLS treatments which are conducted in the presence of hydrogen peroxide. An example is Antifoam A Concentrate defoamer (Merck).

The resulting black liquor soap phase is separated from the aqueous alkaline phase by known separation methods such as filtration, decantation or centrifugation and collected. The weight ratios of the applied aqueous alkaline solution/black liquor soap mixtures range from 1/10 to 20/1, or at least 2/10 to 8/1, or from 4/10 to 5/1, or from 6/10 to 4/1. The extraction processes can be any of batch, continuous, and combinations thereof.

In embodiments, the mixture of black liquor soap and aqueous alkaline solution is heated in an inert atmosphere or in a vacuum, wherein at elevated temperatures, e.g., from 160° C. to 320° C., volatile impurities including but not limited to sulfur containing impurities are evaporated. The process step can be followed with one or more extractions of the resulting black liquor soap composition with an aqueous NaOH solution. In general, the applied vacuum can range from 1 mbar to 500 mbar, or 10 mbar to 400 mbar, or from 25 mbar to 250 mbar. The inert atmosphere is argon, neon, helium, krypton, xenon, steam, hydrocarbons like methane, carbon monoxide, hydrogen, and nitrogen gas.

First at 100° C., the entrained water in BLS is evaporated and subsequently at more elevated temperatures, volatile impurities including but not limited to sulfur containing impurities are evaporated. Under these conditions, GC analyses data show that the main chemical composition had not substantially changed. For example, the relative total amount of abietadienoic acids (e.g., abietic acid, levopimaric acid, neoabietic acid and palustric acid) does not substantially change after 1 hour heating of BLS at 260° C. in an oven under a nitrogen atmosphere. In addition, the relative total amount of abietadienoic acids as compared to the relative amounts of dehydroabietic acid and dihydroabietic acids does not substantially change at this temperature or below.

At heating temperatures higher than 260° C., GC analyses data show that the main chemical composition changes for some of the chemical components, for example, the relative total amount of some fatty acids such as linoleic acid and conjugated linoleic acids decreases and the relative amounts of the rosin acids dehydroabietic acid and dihydroabietic acids increases at the expense of the relative total amount of abietadienoic acids. Fatty acid thermal dimerization reactions and rosin acid disproportionation reactions can account for some of the observed differences in chemical composition by applying BLS heating temperatures higher than 260° C.

The BLS can also be purified by means of heating black liquor soap in an atmosphere like air, which contains a substantial amount of oxygen, for a resulting BLS with decreased sulfur content but generally with a darker color.

In embodiments, the process steps can be repeated and after each extraction, the resulting black liquor soap phase is separated from the aqueous phase, and subsequently collected. After the last extraction, the resulting black liquor soap is optionally neutralized with an acid to adjust the pH to between 10 and 13.

Properties: In embodiments, the BLS treated by the methods described herein has a total solids sulfur content reduced by at least any of 60%, 70%, 80%, and 90%. In one example, the purified BLS has its total solids sulfur content reduced to any of less than 900 ppm, 800 ppm, 700 ppm, 600 ppm, 500 ppm, and less than 400 ppm. The resulting crude tall oil product prepared from the purified BLS has a final solids sulfur content of less than 1100 ppm, 1000 ppm, 900 ppm, and less than 700 ppm. The depitched tall oil product in one embodiment has a total sulfur content of less than any of 400 ppm, 350 ppm, 300 ppm, and 200 ppm.

The depitched tall oil product has a color of any of less than 8 Gardner, 7 Gardner, and 6 Gardner.

With the purification process employing an alkaline solution substantially free from brine, sulfate salts or carbonate salts, the purified BLS is characterized as being substantially free of chloride content. In embodiments, the Cl— content is <5,000 ppm, or <3000 ppm, or <2000 ppm, or <1000 ppm, or <500 ppm, or <100 ppm, or <50 ppm.

End-use Applications/Products made from Desulfurized BLS: The desulfurized/purified BLS is particularly suitable for making tall oil fractions with reduced sulfur contents.

Upon acidification of the desulfurized/purified BLS with an acid such as sulfuric acid, crude tall oil (CTO) is obtained. The crude tall oil (CTO) can be dewatered and depitched in vacuum such as by short path evaporation to give a depitched crude tall oil fraction and tall oil pitch (TOP) fraction. Depitched crude tall oil can be further fractionated by fractional vacuum distillation to obtain tall oil fatty acid (TOFA), distilled tall oil (DTO), and tall oil rosin (TOR) fractions. These compositions are resulting from successive acidulation, dewatering, depitching and subsequent fractionations and chemical reactions of the purified BLS compositions.

In addition to having a reduced sulfur content, products obtained from the purified BLS composition exhibit features such as improved color, color stability, and improved odor properties such as reduced odor intensity and ameliorated odor hedonic tone properties. Light color and color stability are important characteristics for commercial acceptance of these tall oil fractions. Tall oil fatty acids, which consist primarily of oleic and linoleic acids, and tall oil fatty acid derivatives are typically used in alkyd coating, surfactant and emulsifier applications. Tall oil rosin derivatives, particularly esters of polyols such as glycerol and pentaerythritol, are used in products such as adhesives, lacquers and varnishes where a light colored product that retains its color under normal conditions of use is required.

In embodiments, desulfurized compositions derived from purified BLS, and desulfurized TOFA compositions prepared therefrom include TOFA amides, TOFA diamides, TOFA dimer, TOFA dimer derived polyamides, TOFA monomer and hydrogenated TOFA derivatives such as isostearic acid and stearic acid.

In embodiments, compositions prepared from the purified BLS include disproportionated tall oil rosin, hydrogenated tall oil rosin and tall oil rosin esters, including disproportionated tall oil rosin esters and hydrogenated tall oil rosin esters. Rosin esters are derived from one or more TORs and one or more polyhydric alcohols having 2-30 carbon atoms and having 2-10 average hydroxyl functionality, including ethylene glycol, propylene glycol, diethylene glycol, triethylene glycol, tetraethylene glycol, trimethylene glycol, 4,4'-isopropyl-idenedicyclohexanol, 1,4-cyclohexanedimethanol, 2,2,4,4-tetramethyl-1,3-cyclobutanediol, 4,8-bis(hydroxymethyl)tricyclo[5.2.1.$0^{2,6}$]decane, glycerol, diglycerol, polyglycerol, polyglycerol-2, polyglycerol-3, polyglycerol-4, trimethylolpropane, trimethylolethane, pentaerythritol, dipentaerythritol, tripentaerythritol, mannitol, sorbitol, and xylitol. Optionally, one or more catalysts and color reducing agents can be applied during the rosin ester preparation. Non-limiting examples of esterification catalysts are Irganox® 1425, ZnO and MgO. Non-limiting examples of color reducing agents are 9-fluorenone and xanthone. In embodiments, the tall oil rosin composition has a sulfur content<400 ppm, or <300 ppm, or <250 ppm. In embodiments, the tall oil rosin ester composition has a color of <3 Gardner, or <2 Gardner.

Other embodiments include one or more polyhydric alcohols having 2 to 30 carbon atoms and having 2 to 10 average hydroxyl functionality alcohol, and optionally more than 0 up to 10 wt. % of all reactants of one or more dicarboxylic acid functional organic compounds. In embodiments, the desulfurized compositions derived from the desulfurized TOR compositions are oligoesters which are derived from one or more TORs, one or more TOFAs, one or more polyhydric alcohols, and optionally with up to 10 wt. % of all reactants of one or more dicarboxylic acid functional organic compounds. Other embodiments of desulfurized compositions resulting from the purified BLS include oligoesters and TOP esters, originating from a chemical reaction of TOP with one or more polyhydric alcohols having 2 to 30 carbon atoms and having 2 to 10 average hydroxyl functionality, and optionally more than 0 up to 10 wt. % of all reactants of one or more dicarboxylic acid functional organic compounds.

EXAMPLES: The examples are given by way of illustration and are not intended to limit the specification or the claims to follow in any manner.

Sulfur content (expressed as parts per million or ppm) can be measured according to ASTM D5453-05. Sulfur content can also be determined by Inductively Coupled Plasma with optical emission spectroscopy (ICP-OES) spectrometry or Inductively Coupled Plasma with mass spectrometry (ICP-MS).

Total chloride content (sum of Cl and chloride (Cl-), expressed as ppm) can be determined by sample combustion of an aliquot of accurately weighed sample, typically between 50 and 500 mg, in an oxygen bomb charged with 25-30 atmospheres of oxygen which is fired, whereafter the combustion gases are absorbed in a known volume of reducing solution (1% hydrogen peroxide). Measurement of chloride content in the resulting solution is performed by means of suppressed ion chromatography detection method, which is based on ASTM D 4327: Standard Test Method for Anions in Water by Chemically Suppressed Ion Chromatography. Instrument: Dionex Model DX500 chromatograph. Column: Dionex® IonPac® AS9-SC 4×250 mm. Eluent: 2.4 mM Na2CO3: 1.8 mM NaHCO3. Sample introduction: Auto injection (Hitachi Model AS7200). Determination: Conductivity detection/linear regression.

Gardner color can be measured according to ASTM D1544-04 (2010).

Rosin acid and tall oil fatty acid content in crude tall oil and its fractionation products can be determined according to ASTM D5974-00 (2010).

In examples to convert the BLS composition into the corresponding CTO composition, a sample (1.00 g) and 10 mL 2N potassium hydroxide (KOH) in ethanol were added to tall oil in a high pressure microwave reaction vessel. The sample was saponified in a microwave for 30 minutes at 150° C. Upon completion of the microwave-assisted saponification, the reaction mixture was transferred to a separatory funnel, and dilute hydrochloric acid was added to reduce the pH value to <4 to convert the rosin and/or fatty acid soaps to rosin and/or fatty acids. The resulting rosin acids were isolated by way of diethyl ether extraction. Upon removal of the diethyl ether solvent, the rosin acids were derivatized and analyzed according to ASTM D5974-00 (2010).

Oven heating experiments were conducted in a nitrogen atmosphere unless indicated otherwise. Oven heating rates amounted to approximately 100° C./hour. One hour heating at the given oven temperature was applied unless indicated otherwise. BLS water content was derived by either determining the weight (mass) difference between aqueous BLS starting material and obtained BLS after heating to 160° C. in an oven under $N_2$ for 1 hour, or by applying an electronic moisture analyzer. If M1 is the weight of the initial (wet) BLS sample and M2 the weight following drying, the BLS total solids content is expressed as a ratio of weights obtained before and after the drying process and is expressed as M2/M1.

BLS total solids sulfur content (abbreviated as TSSC, expressed in ppm) can be calculated by dividing the sulfur content value of the wet BLS by the BLS total solids content. For example, BLS A, having a sulfur content of 1954 ppm and water content of 39 wt %, has a BLS total solids content of 1-0.39=0.61 and a calculated BLS total solids sulfur content (TSSC) value of 1954/0.61=3203 ppm.

In the examples, three BLS materials were applied: BLS A: S content 1954 ppm, water content 39 weight %; BLS B: S content 1469 ppm, water content 36 wt. %; BLS C: S content 1650 ppm, water content 34 wt. %, and 40 ppm total chloride content.

In the tables, weight percent is wt. %; hour: hr.; minute: min; gram: g; liter: L; nitrogen: N2; room temperature: R.T.; sulfur: S; aqueous: aq.

Example 1. BLS A (100 g) was heated in an oven at 180° C. in $N_2$ atmosphere during which the formed water vapor was allowed to escape. After 1 hr. heating, sample was cooled to R.T. The formed anhydrous solid BLS showed S content of 1958 ppm.

Examples 2-9. An analogous procedure as described in Example 1 was executed with varying applied oven temperatures. Results and conditions are provided in Table 1. Since the entrained water in BLS has evaporated during the oven heating, resulting purified BLS sulfur content values equal the calculated TSSC values in examples 1-9.

TABLE 1

| Example | Unpurified BLS type | Unpurified BLS Sulfur content ppm | Unpurified BLS TSSC ppm | Heating temperature (° C.) | Atmosphere | Purified BLS Sulfur content (ppm) |
|---|---|---|---|---|---|---|
| 1 | BLS A | 1954 | 3203 | 180 | $N_2$ | 1958 |
| 2 | BLS A | 1954 | 3203 | 225 | $N_2$ | 1691 |
| 3 | BLS C | 1650 | 2500 | 160 | $N_2$ | 1761 |
| 4 | BLS C | 1650 | 2500 | 246 | $N_2$ | 1496 |
| 5 | BLS C | 1650 | 2500 | 256 | $N_2$ | 1443 |
| 6 | BLS C | 1650 | 2500 | 275 | $N_2$ | 1409 |
| 7 | BLS C | 1650 | 2500 | 297 | $N_2$ | 1329 |
| 8 | BLS C | 1650 | 2500 | 317 | $N_2$ | 1208 |
| 9 | BLS C | 1650 | 2500 | 250 | Air | 1504 |

Example 10. 100 g BLS B was added to a flask, equipped with thermocouple, $N_2$ gas inlet and outlet, mechanical stirrer and dropping funnel. A heating mantle was applied. 200 g aq. NaOH (20 wt. % NaOH, specific gravity (15/4° C.) 1.224, 6.12 mol NaOH/L) was slowly added during 30 min by a dropping funnel to the stirred mixture at 60° C. After the addition, the mixture was stirred for one hour. The aq. NaOH layer was allowed to separate from the BLS layer during 30 min at 60° C. and separated from the upper BLS layer. The collected BLS fraction showed S content of 524 ppm.

Example 11. The BLS material formed in example 10 was extracted twice according to procedure of example 10 to provide purified BLS having S content of 381 ppm.

Example 12. 100 g BLS A was extracted according to the procedure of example 10 with two modifications: A) a 1:1 weight ratio of 20 wt. % aq. NaOH:BLS was applied, and B) the BLS layer after the extraction was separated by centrifugation (3000 rpm for 3 min). This extraction procedure was repeated twice. The obtained BLS fraction after the third extraction showed S content of 345 ppm. The calculated BLS total solids sulfur content (TSSC) value amounted to 345/0.65=531 ppm.

Example 13. The procedure of example 12 was conducted with two modifications: A) a 1:2 weight ratio of 20 wt. % aq. NaOH:BLS was applied and, B) a temperature of 85° C. was applied. The obtained BLS fraction after the third extraction showed S content of 453 ppm.

Example 14. The procedure of example 12 was conducted but with 300 g and at 70° C., with two consecutive extractions. The BLS fraction after the second extraction showed S content of 412 ppm.

Example 15. The procedure of example 12 was conducted with 100 g BLS with the following three modifications: A) a 3:1 weight ratio of 20% aq. NaOH:BLS was applied, B) a temperature of 70° C. was applied, and C) one extraction was performed. The collected BLS fraction showed S content of 419 ppm.

Example 16. The procedure of example 15 was conducted with BLS C with the following modification: a 2:1 weight ratio of 20 wt. % aq. NaOH:BLS was applied. The collected BLS fraction showed S content of 535 ppm.

Example 17. The procedure of example 15 was conducted with BLS C with two modifications: A) a 1:1 weight ratio of 7 wt. % aq. NaOH, 1.89 mol NaOH:BLS was applied, and B) one extraction was performed. 102.7 g BLS was extracted. The collected BLS fraction (98.9 g) showed S content of 661 ppm, and less than 66 ppm total chloride content.

Example 18. The procedure of example 17 was conducted with one modification: a 5:2 weight ratio of 5 wt. % aq. NaOH, 1.32 mol NaOH:BLS was applied. The collected BLS fraction showed S content of 507 ppm.

Example 19. BLS obtained analogously to the procedure of example 14 was heated as described in example 1. The resulting BLS showed S content of 479 ppm.

Example 20. BLS obtained analogously to the procedure of example 14 was heated analogously to the procedure of example 1 but at 199° C. instead of 180° C. The resulting anhydrous BLS showed S content of 460 ppm.

Example 21. BLS obtained analogously to the procedure of example 14 was heated analogously to the procedure of example 1 but at 220° C. The resulting anhydrous BLS showed S content of 418 ppm.

Example 22. BLS obtained analogously to the procedure of example 14 was heated analogously to the procedure of example 1, but at 227° C., followed by heating for 1 hr. in vacuum (375 mbar) at 227° C. The resulting BLS showed S content of 407 ppm.

Example 23. BLS obtained analogously to the procedure of example 14 was heated for 1 hr. in vacuum (375) mbar at 227° C. The resulting anhydrous BLS showed S content of 442 ppm.

Example 24. BLS obtained analogously to the procedure of example 14 was heated analogously to the procedure of example 1 but at 255° C. The resulting anhydrous BLS showed S content of 370 ppm.

Example 25. The procedure of example 18 was conducted with one modification: A) a 1:1 weight ratio of 5 wt. % aq. NaOH:BLS was applied. The collected BLS was heated analogously to the procedure of example 1 but at 250° C. The resulting anhydrous BLS showed S content of 641 ppm.

Example 26. The procedure of example 18 was conducted with a modification: a 1:1 weight ratio of 10 wt. % aq. NaOH (2.78 mol NaOH/L):BLS was applied. The obtained BLS layer was heated analogously to the procedure of example 1 but at 235° C. The obtained BLS showed S content of 668 ppm.

Example 27. The procedure of example 26 was conducted with a modifications: a 1:1 weight ratio of 4.5 wt. % aq. NaOH (1.17 mol NaOH/L):BLS was applied. The resulting anhydrous BLS showed S content of 772 ppm.

Example 28. The obtained BLS in example 17 was heated analogously to the procedure of example 1 but at 250° C. The resulting BLS showed S content of 700 ppm.

Example 29. The obtained BLS in example 18 was heated analogously to the procedure of example 28. The resulting BLS showed S content of 591 ppm.

Example 30. To 46.24 g of the obtained anhydrous BLS in example 4 was added 25.45 g water. To the resulting mixture was added 214.92 g of 7 wt. % aq. NaOH. Extraction was performed analogously to the procedure of example 15 with the following modification: a 3:1 weight ratio of 7 wt. % aq. NaOH:BLS was applied. The obtained BLS after the extraction showed S content of 332 ppm.

Example 31. Purified BLS material (having less than 66 ppm total chloride content and S content of 513 ppm, TSSC value 789 ppm) obtained from BLS C, analogously to the procedure of example 15 by applying 7 wt. % aq. NaOH instead of 20 wt. % aq. NaOH, was subsequently adjusted to pH=12.9 with 0.2 wt. % aq. $H_2SO_4$. The resulting BLS was heated to 250° C. for 1 hr. analogously to the procedure described in example 2. A 40 wt. % portion of water was added to the obtained anhydrous BLS.

The resulting mixture was acidulated to CTO. The BLS was heated to 80° C. 50 wt. % aq. $H_2SO_4$ was slowly added by a dropping funnel to the BLS until a pH value of 2 was obtained. The resulting mixture was subjected to collect the CTO phase and wash with water. The resulting CTO showing S content of 520 ppm was depitched in a wiped film evaporator at a pressure of 0.2 mm Hg, at 180° C., by applying a feed rate of 3.5 mL/min. A depitched CTO fraction showed S content 157 ppm, Antek method, S content 268 ppm, ICP-OES, color 6.1 Gardner, and a tall oil pitch fraction showed S content 1855 ppm, Antek method; S content 2739 ppm, ICP-OES method were obtained.

Example 32. BLS C was heated analogously to the procedure of example 2 but with applied oven temperature of 200° C. Part of the formed BLS (60.92 g) was dissolved in water (40.61 g). The resulting mixture was extracted with 304.6 g of 7 wt. % aq. NaOH analogously to the procedure of example 15. The resulting BLS showed S content of 420 ppm (TSSC value 646 ppm) and was subsequently acidulated into CTO analogously to the procedure of example 31. The S content of the obtained CTO amounted to 736 ppm.

Example 33 (Comparative). BLS C was acidulated analogously to the procedure of example 31 to give CTO having an S content of 1727 ppm.

Example 34 (Comparative). BLS B was acidulated to CTO and depitched analogously to the procedure of example 31. A depitched tall oil fraction (S content 431 ppm, Antek method, S content 528 ppm, ICP-OES, color 8.3 Gardner) and a tall oil pitch fraction (S content 3383 ppm, Antek method; S content 6441 ppm, ICP-OES) were obtained.

Example 35. Solution A was prepared by dissolving NaOH (20 g) and $H_2O_2$ (10 g of a 35 wt. % aq. solution) in water (70 g). BLS A was extracted at 85° C. with 100 g of solution A slowly added by using a dropping funnel and rapid stirring (750 rpm) to control foaming. After the addition, the resulting mixture was kept at 60° C. for 30 min without stirring, subsequently heated up to 85° C. and thereafter stirred for 1 hr. (300 rpm). The resulting BLS layer was separated from the mixture by centrifugation. The collected BLS fraction showed S content of 606 ppm.

Example 36. The procedure of example 12 was executed with the following modification: A) a 1:2 weight ratio of 20 wt. % aq. NaOH:BLS was applied starting with 101.5 g BLS A. The collected BLS fraction after the third extraction showed S content of 453 ppm and a water content of 35 wt. %.

Example 37. Purified BLS material obtained from BLS C, analogously to the procedure of example 15 by applying 7 wt. % aq. NaOH instead of 20 wt. % aq. NaOH, was subsequently heated to 175° C. for 1 hr. analogously to the procedure described in example 1. The obtained anhydrous BLS showed S content of 561 ppm.

Example 38. Solution B was prepared by dissolving NaOH (6.52 g) and $H_2O_2$ (2.71 g of a 35 wt. % aq. solution) in water (86.52 g). Antifoam A Concentrate (0.1 g) (Merck) was added to BLS B (92.98 g). The resulting BLS was treated at 20° C. with 95.75 g of solution B which was slowly added (dropping funnel) under rapid stirring (750 rpm). The resulting mixture was slowly heated to 65° C. and stirred for 15 min. The resulting BLS layer was separated from the mixture by centrifugation (3000 rpm for 3 min) and showed S content of 536 ppm. Subsequent acidulation analogously to the procedure of example 31 gave CTO having S content of 803 ppm. 23.44 g of the obtained CTO was dehydrated at 300 mbar at 160° C. prior to depitching. Depitching was performed by vacuum distillation (conditions: 1.7 mbar, 160-205° C., 4 cm distillation bridge height) which gave a depitched CTO distillate (17.43 g, S content 254 ppm) and a tall oil pitch residue (S content 2883 ppm).

Example 39. BLS B (93.47 g) was mechanically stirred and heated to 85° C. in an $N_2$ atmosphere. 281.05 g of a 6 wt. % aqueous NaOH solution was added, followed by addition of $H_2O_2$ (0.56 g of a 35 wt. % aq. solution). The resulting mixture was stirred for 1 h at 85° C. and centrifuged according to the procedure of example 38 to give a desulfurized BLS fraction (S content of 362 ppm).

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained. It is noted that, as used in this specification and the appended claims, the singular forms "a," "an," and "the," include plural references unless expressly and unequivocally limited to one referent. As used herein, the term "include" and its grammatical variants are intended to be non-limiting, such that recitation of items in a list is not to the exclusion of other like items that can be substituted or added to the listed items. As used herein, the term "comprising" means including elements or steps that are identified following that term, but any such elements or steps are not exhaustive, and an embodiment can include other elements or steps.

Unless otherwise specified, the recitation of a genus of elements, materials or other components, from which an individual component or mixture of components can be selected, is intended to include all possible sub-generic combinations of the listed components and mixtures thereof.

The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims. To an extent not inconsistent herewith, all citations referred to herein are hereby incorporated by reference.

The invention claimed is:

1. A method of purifying black liquor soap (BLS) from sulfur compounds for a purified BLS having a reduced total solids sulfur contents, the method consisting essentially of:

subjecting the BLS to one or more extractions at a temperature between 60° C. to 85° C. with an aqueous alkaline solution comprising 1-15 mol/L of inorganic base, wherein the inorganic base is selected from the group consisting of NaOH, LiOH, KOH and any combination thereof, the weight ratio of the applied aqueous alkaline solution/black liquor soap mixture is greater than 1/10 and less than 20/1; and optionally heating the BLS in an inert atmosphere or in a vacuum at a temperature of 160° C. to 320° C.;

wherein the alkaline solution is substantially free from brine, sulfate salts and carbonate salts, wherein the total solids sulfur content of the BLS is reduced by at least 30%, and wherein the purified BLS has a chloride content of less than 1000 ppm.

2. The method of claim 1, wherein the aqueous alkaline solution in one or more extractions further comprises 0.01 to 4 wt. % of hydrogen peroxide.

3. The method of claim 1, wherein the inert atmosphere is selected from the group consisting of argon, neon, helium, krypton, xenon, steam, hydrocarbons like methane, carbon monoxide, hydrogen, and nitrogen gas and combinations thereof.

4. The method of claim 1, wherein the BLS is heated in an inert atmosphere or in a vacuum at a temperature of 180° C. to 260° C.

5. The method of claim 4, wherein the BLS is heated in an inert atmosphere or in vacuum applied between 1 mbar and 500 mbar.

6. The method of claim 1, further comprising: subjecting the purified BLS to acidification to adjust the pH value to between 10 and 13.

7. The method of claim 1, wherein the total solids sulfur content of the BLS is reduced by at least 70%.

8. The method of claim 1, wherein the total solids sulfur content of the BLS is reduced to less than 700 ppm.

9. A purified black liquor soap (BLS) having a reduced total solids sulfur content obtained by a method consisting essentially of:

subjecting the BLS to one or more extractions at a temperature between 60° C. to 85° C. with an aqueous alkaline solution comprising 1-15 mol/L of inorganic base, wherein the inorganic base is selected from the group consisting of NaOH, LiOH, KOH and any combination thereof, the weight ratio of the applied aqueous alkaline solution/black liquor soap mixture is greater than 1/10 and less than 20/1; and optionally heating the BLS in an inert atmosphere or in a vacuum at a temperature of 160° C. to 320° C.;

wherein the alkaline solution is substantially free from brine, sulfate salts and carbonate salts, wherein the total solids sulfur content of the BLS is reduced by at least 30%, and wherein the purified BLS has a chloride content of less than 1000 ppm.

10. A method of making a biorenewable product, the method consisting essentially of:

purifying black liquor soap (BLS) from sulfur compounds for a purified BLS having a reduced total solids sulfur contents by:

subjecting the BLS to one or more extractions at a temperature between 60° C. to 85° C. with an aqueous alkaline solution comprising 1-15 mol/L of inorganic base, wherein the inorganic base is selected from the group consisting of NaOH, LiOH, KOH and any combination thereof, the weight ratio of the applied aqueous alkaline solution/black liquor soap mixture is greater than 1/10 and less than 20/1; and optionally heating the BLS in an inert atmosphere or in a vacuum at a temperature in the range of 160° C. to 320° C.;

wherein the alkaline solution is substantially free from brine, sulfate salts and carbonate salts, wherein the total solids sulfur content of the BLS is reduced by at least 30%, and wherein the purified BLS has a chloride content of less than 1000 ppm;

acidifying the purified BLS with an acid such as sulfuric acid to obtain a crude tall oil;

subjecting the crude tall oil to one or more depitching and fractional vacuum distillation steps obtaining fractions; and subjecting the obtained fractions to one or more processes selected from dimerization, trimerization, isomerization, aromatization, disproportionation, catalytic hydrogenation, esterification and amidation reactions.

11. The method of claim 10, wherein the biorenewable product is a tall oil rosin ester composition, a distilled tall oil ester composition, a tall oil fatty acid ester composition, a tall oil pitch ester composition, a tall oil fatty acid dimer composition, a tall oil fatty acid trimer composition, a tall oil fatty acid monomer composition, a tall oil fatty acid dimer derived polyamide composition, a tall oil fatty acid dimer derived diamide composition, a tall oil fatty acid derived diamide composition, a tall oil fatty acid derived monoamide composition, a tall oil fatty acid monomer derived diamide composition, a tall oil fatty acid monomer derived monoamide composition, stearic acid, or isostearic acid.

* * * * *